US005636447A

United States Patent [19]

Yount et al.

[11] Patent Number: 5,636,447

[45] Date of Patent: Jun. 10, 1997

[54] APPARATUS AND METHOD FOR MOVING ARTICLES TO DESIRED LOCATIONS

[75] Inventors: Gary L. Yount, Morrison; Roger L. Kobak, Aurora; William J. Keener, Littleton; Clinton W. Rutledge, Lakewood, all of Colo.

[73] Assignee: Preferred Machining Corporation, Englewood, Colo.

[21] Appl. No.: 227,450

[22] Filed: Apr. 14, 1994

[51] Int. Cl.[6] ..... F26B 25/00

[52] U.S. Cl. ..... 34/105; 34/104; 34/498; 34/236

[58] Field of Search ..... 34/104, 105, 498, 34/236, 217, 107; 221/103, 104, 105, 106, 107, 108, 109, 110

[56] References Cited

U.S. PATENT DOCUMENTS

| | | |
|---|---|---|
| 693,019 | 2/1902 | Holmes . |
| 699,690 | 5/1902 | Leetham . |
| 1,038,241 | 9/1912 | Vise et al. . |
| 1,090,777 | 3/1914 | Clark . |
| 2,181,190 | 11/1939 | Lewers . |
| 2,498,601 | 2/1950 | Bylin et al. . |
| 3,155,245 | 11/1964 | Brandon . |
| 3,367,044 | 2/1968 | Fitch . |
| 3,793,745 | 2/1974 | Myers . |
| 3,854,864 | 12/1974 | Mendoza . |
| 4,333,246 | 6/1982 | Sullivan et al. . |
| 4,808,057 | 2/1989 | Chiappe et al. . |
| 5,193,970 | 3/1993 | Chiappe et al. . |

FOREIGN PATENT DOCUMENTS

| | | |
|---|---|---|
| 52-53368 | 4/1977 | Japan . |
| 688799 | 10/1979 | U.S.S.R. . |

*Primary Examiner*—John M. Sollecito
*Assistant Examiner*—Dinnatia Doster
*Attorney, Agent, or Firm*—Klaas, Law, O'Meara & Malkin, P.C.; Joseph J. Kelly

[57] ABSTRACT

Apparatus for moving articles, such as lids for containers, from one location to other locations depending on processing requirements of a manufacturing operation wherein a continuous supply of lids are separated into units, each having a plurality of lids, which units are moved into a plurality of infeed stations and transferred to one of a plurality of inclined generally planar surfaces in spaced apart generally parallel relationship and wherein the lids roll over the inclined generally planar surfaces under the influence of gravity and wherein the transfer of a unit from an infeed station to one of the plurality of inclined generally planar surfaces and the movement thereover is controlled by a plurality of pivotally mounted gates. Heating means are provided for curing a heat curable coating on portions of the lids when necessary. Also, storage trays are provided so that the longitudinal axis of a plurality of lids can be aligned with the longitudinal axis of one of a plurality of compartments in the tray and the plurality of lids can be pushed into or removed from one of the compartments.

39 Claims, 7 Drawing Sheets

APPARATUS AND METHOD FOR MOVING ARTICLES TO DESIRED LOCATIONS

FIELD OF THE INVENTION

This invention relates generally to the operation of a manufacturing facility and more specifically to apparatus and method for ensuring the independent efficient operation of various machines used in such a manufacturing facility.

BACKGROUND OF THE INVENTION

In U.S. Pat. No. 4,808,057 to Chiappe et al., there is described a control system for controlling the movement of lids to various parts of a lid forming operation. A modification of the apparatus in the '057 patent is disclosed in U.S. Pat. No. 5,193,970 to Chiappe et al. Each of these patents use conveyors to move lids to various locations in the lid forming operation according to supply and demand. Each of these patents use some type of mechanism to pick up a stack of lids and transfer them to one of a plurality of storage trays. Also, each of these patents discloses a system for removing stacks of lids from storage and back onto one of the conveyors. While applicants are not skilled in the operation of the structures in the above-identified patents, there is disclosed in these patents a lot of structures to try to accomplish its stated purpose. Therefore, applicants believed there was a need for a less complicated system to accomplish the desired purpose.

BRIEF DESCRIPTION OF THE INVENTION

This invention provides apparatus for moving articles, such as lids for containers, for ensuring the efficient operation of various components of a lid manufacturing facility using a plurality of generally planar surfaces which are in a substantially parallel relationship and inclined to the horizontal so that the lids will move over the inclined planar surfaces under the control of gravity. A plurality of pivotally mounted gates are provided to transfer a plurality of lids from one of the generally planar surfaces to another of the generally planar surfaces and to control the rolling movement of the lids over the generally planar surfaces to processing means or the movement of the lids into storage.

The invention will be described in relation to the manufacture of lids for containers but it is understood that the apparatus can be used in association with any product having a circular outer surface. In a preferred embodiment of the invention, a continuous strip of aluminum or steel is led into a shell press for forming shells for lids which are then moved into a curl former. The curled lids are moved into a first apparatus of this invention where they are either moved into a cell storage container, are bagged or are moved into a lid liner depending on the needs of the apparatus. Lined lids from the lid liner are moved into a second apparatus of this invention by which they are either moved into a cell storage container, are bagged or are moved into a conversion press depending on the needs of the apparatus. If a heat curable coating has been applied to the lined lids, the apparatus of this invention will have heating means for curing the heat curable coating. After the conversion press, the lids are moved into a third apparatus of this invention by which they are moved either into a cell storage container or bagged.

In a preferred embodiment of the invention, the apparatus for moving the lids from one location to another comprises a plurality of spaced apart infeed stations. Moving means are provided for moving a plurality of lids in succession into each of the infeed stations. Each of the infeed stations has a bottom surface which is generally planar and inclined relative to the horizontal. Each of the lids has a circular outer rim adapted to roll over the bottom surfaces. First abutment means are associated with each of the infeed stations for contacting the opposite end lids of each plurality of lids in each of the infeed stations so that the generally circular outer rims of the plurality of lids are in contact with the bottom surfaces. At least a plurality of generally planar surfaces are provided and are vertically spaced apart in a generally parallel relationship and inclined to the horizontal. Second abutment means are associated with the at least two generally planar surfaces and are located to be contacted by said opposite end lids so that a plurality of lids will roll over each of the at least two generally planar surfaces. A plurality of gate means are provided for controlling the movement of a plurality of lids out of at least one of the plurality of infeed stations and over the at least two generally planar surfaces. Each of the at least two generally planar surfaces has an end portion. Processing means are provided at the end portion of each of the at least two generally planar surfaces for receiving a plurality of lids that have moved over each of the at least two generally planar surfaces.

The plurality of gates comprise first gate means for preventing movement of the plurality of lids out of the at least one of the plurality of spaced apart infeed stations. First pivot means are provided for pivoting the first gate means between locations for preventing or permitting movement of the plurality of lids out of the at least one of the plurality of spaced apart infeed stations. At least one holding station is provided and has a bottom surface aligned with the bottom surfaces of at least one of the infeed stations and abutment means for retaining a plurality of lids in contact with the bottom surface thereof. Second gate means are provided and comprise at least a portion of the bottom surface of the at least one holding station. Second pivot means are provided for pivoting the second gate means between locations for supporting a plurality of lids on the second gate means or permitting movement of a plurality of lids out of the at least one holding station and onto at least a portion of one of the plurality of generally planar surfaces. Third gate means are provided for preventing the movement of the plurality of lids on the at least a portion of the one of the plurality of generally planar surfaces. Third pivot means are provided for pivoting the third gate means between locations for preventing or permitting movement of a plurality of lids over the plurality of generally planar surfaces. The third pivot means permit the pivoting of the third gate means through 360 degrees so as to apply a force on the plurality of lids to start movement thereof in the event that movement thereof has not been commenced.

In one preferred embodiment of the invention, there are three infeed stations with at least two infeed stations having aligned planar bottom surfaces and the other infeed station having a planar bottom surface parallel to but spaced below the planar bottom surfaces of the two infeed stations. This embodiment has three generally planar surfaces over which the lids may roll. However, it is to be understood that the number of infeed stations, generally planar surfaces, gates, processing means and storage means can be varied from one or more to accommodate required processing needs.

In another preferred embodiment of the invention, heating means are provided to cure a heat curable coating applied to the lids. The heating means comprise a housing having an entrance portion and an exit portion permitting the passage therethrough of a plurality of generally planar surfaces. In this embodiment, the plurality of generally planar surfaces are fluid permeable. An air blower is mounted in the housing and is supplied with heated air so that the air blower blows heated air over and through the lids and the fluid permeable generally planar surfaces and exits through and exit portion of the housing. The abutments holding the lids on the generally planar surfaces are spaced apart a distance greater than the distance between the opposite end lids of the plurality of lids as they are fed into each infeed station so that the lids are free to separate slightly to permit the heated air to flow therebetween.

The end portion of one of the generally planar surfaces has means for moving a plurality of lids into a lid bagging operation.

In another embodiment of the invention, there is provided a lid storage system comprising a plurality of trays which can be stacked in superposed relationship. Each tray comprises a plurality of spaced apart base members and sidewalls projecting upwardly from the base members to form a plurality of spaced apart compartments. Each of the compartments has opposite end portions and are dimensioned to hold a plurality of lids. Abutment means are provided at each of the opposite end portions for contacting an end lid of the plurality of lids to retain the plurality of lids in each of the compartments. At least one of the abutment means is flexible to be moved to a location permitting the plurality of lids to be pushed into each of the compartments and to return to a location in contact with one of the end lids of the plurality of lids. The other of the abutment means comprises a first end wall integral with the base members and the sidewalls and extending downwardly therefrom to form an abutment means for the lids in an underneath tray. A second end wall is also integral with the base members and the sidewalls and extends downwardly therefrom and has a plurality of cut out portions located beneath each of the sidewalls to accommodate a flexible strip of material that is secured to each of the sidewalls and extends downwardly into each of the cut out portions to be contacted by an end lid in an underneath tray. Lids are not inserted into the compartments of the top tray when a plurality of trays are in a stacked relationship. Each of the first and second end walls is inclined relative to a vertical direction to permit nesting of the trays. At least one of the gates and at least a portion of at least one generally planar surface form holding means for holding a plurality of lids to have a longitudinal axis. Each of the compartments has a longitudinal axis. The plurality of trays are supported to be capable of movement in vertical and horizontal directions. Indexing means are provided to move the plurality of trays to successively align each longitudinal axis of the compartments into alignment with a plurality of lids in the holding means. Moving means, such as a pneumatic cylinder, move the plurality of lids out of the holding means and into a compartment and another plurality of lids moves into the holding means. This operation is repeated until the desired number of compartments have been filled. When it is desired to move a plurality of lids from the compartments to the holding means, the longitudinal axes of each compartment and the holding means are aligned and another moving means, such as another pneumatic cylinder, moves the plurality of lids from each compartment into the holding means.

A mechanical system is also provided for controlling the rolling movement of the lids over the plurality of generally planar surfaces. A plurality of spaced apart shafts are each rotatably mounted in a fixed support. A gate is mounted on each shaft for rotation therewith. A latch cam is also mounted on each shaft for rotation therewith and has an abutment surface formed thereon. A freely pivoted latch is mounted on each shaft and is located to move into contact with the abutment surface on the latch cam mounted immediately before it. A cam pin is also mounted on each latch cam and is located to contact the freely pivoted latch and move it out of contact with the abutment surface. When a control means permits a first plurality of lids to rotate a first gate so that the first plurality of lids can move through the first gate, the freely pivoted latch prevents movement of a second gate by a second plurality of lids. After the first plurality of lids have moved past the first gate, the first gate will move downwardly and rotate the latch cam to move the cam pin upwardly to move the freely mounted latch away from the abutment surface to permit the second plurality of lids to rotate the second gate.

BRIEF DESCRIPTION OF THE DRAWINGS

Illustrative and presently preferred embodiments of the invention are shown in the accompanying drawings in which.

DETAILED DESCRIPTION OF THE INVENTION

Figure 1:
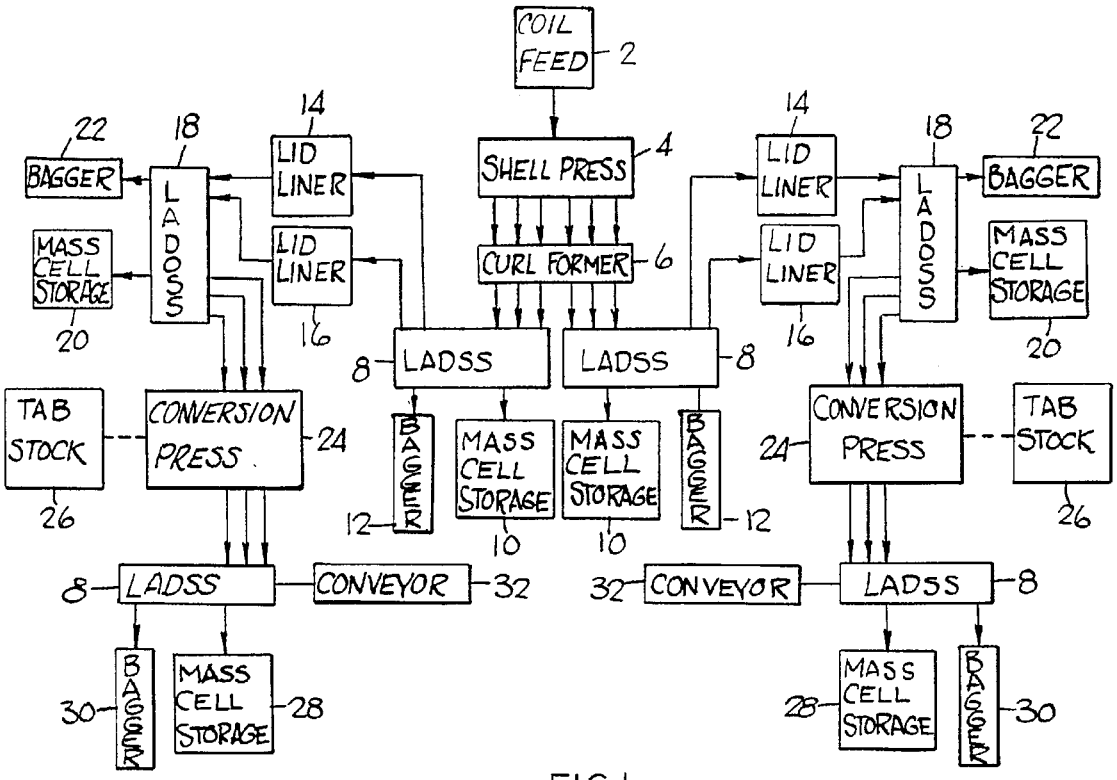
FIG. 1 is a flow diagram of the apparatus associated with a preferred embodiment of the invention.

In FIG. 1, there is illustrated a flow diagram of a preferred lid manufacturing apparatus for which this invention is particularly suited but the invention can be utilized with other types of apparatus for manufacturing other articles. A coil 2 of metal, preferably aluminum or steel, is fed into a shell press 4 where a plurality of lids are initially formed. From the shell press 4, the lids are fed into a curl former 6 in which the rim portions of the lids are formed. As illustrated in FIG. 1, the shell press 4 and the curl former 6 are large enough to supply two lines associated with this invention, which is for illustration purposes only since one or more lines could be accommodated. From the curl former 6, the lids are fed into one of two Lid Accumulator Diverter Storage Systems, LADSS 8. From the LADSS 8, the lids are fed either into a mass cell storage 10, a bagger 12 or one of two lid liners 14 and 16 wherein a coating material is applied to the inside rim portion for lid sealing purposes. If the coating material is heat curable, the coated lids are fed into a Lid Accumulator Diverter Oven Storage System, LADOSS 18. This LADOSS 18 is preferably also used with non-heat curable coated lids with the heating means not activated or a LADSS 8 can be at this location. From the LADOSS 18, the lids are fed either into another mass cell storage 20, another bagger 22 or to a conversion press 24. Tabs from the tab stock 26 are fed into the conversion press 24 where score lines are formed in the lids and the tabs are applied thereto. From the conversion press 24, the lids are fed into another LADSS 8 from which the lids are fed into another mass cell storage 28, another bagger 30 or to a conveyor 32 for movement to a can filling and seaming operation.

Figure 3:
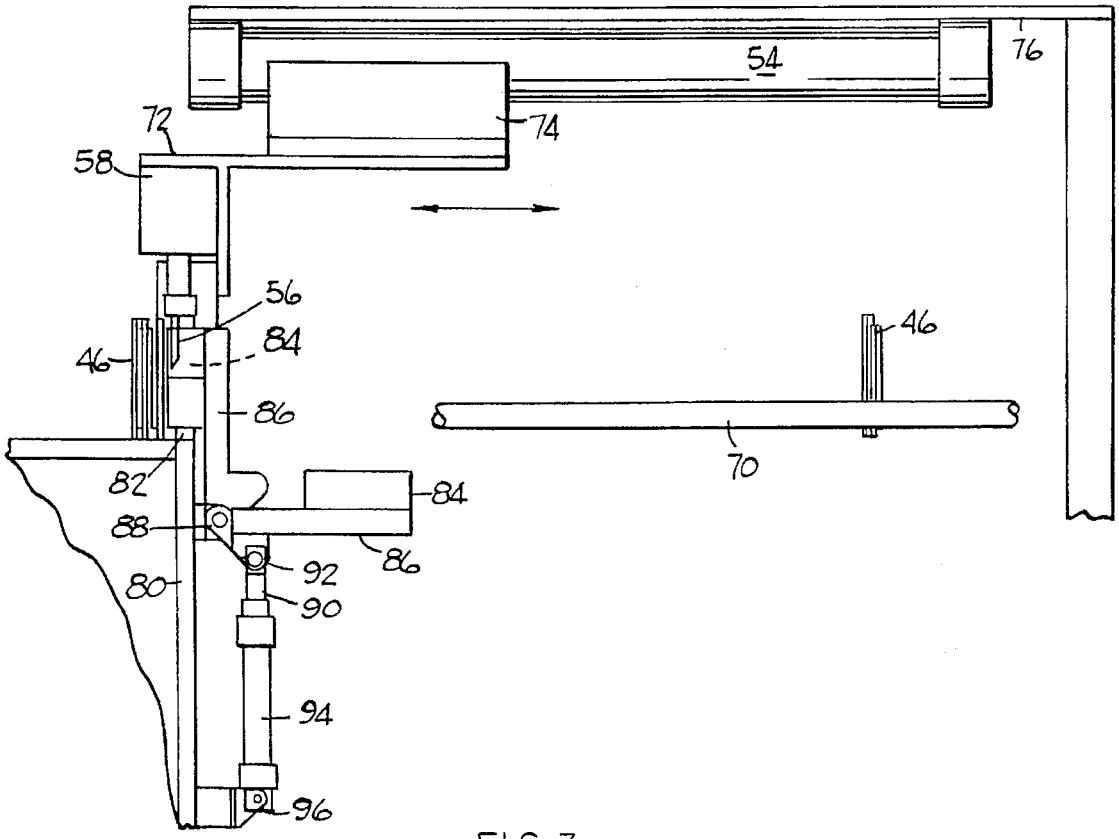
FIG. 3 is an enlarged view of a portion of FIG. 2.
Figure 2:
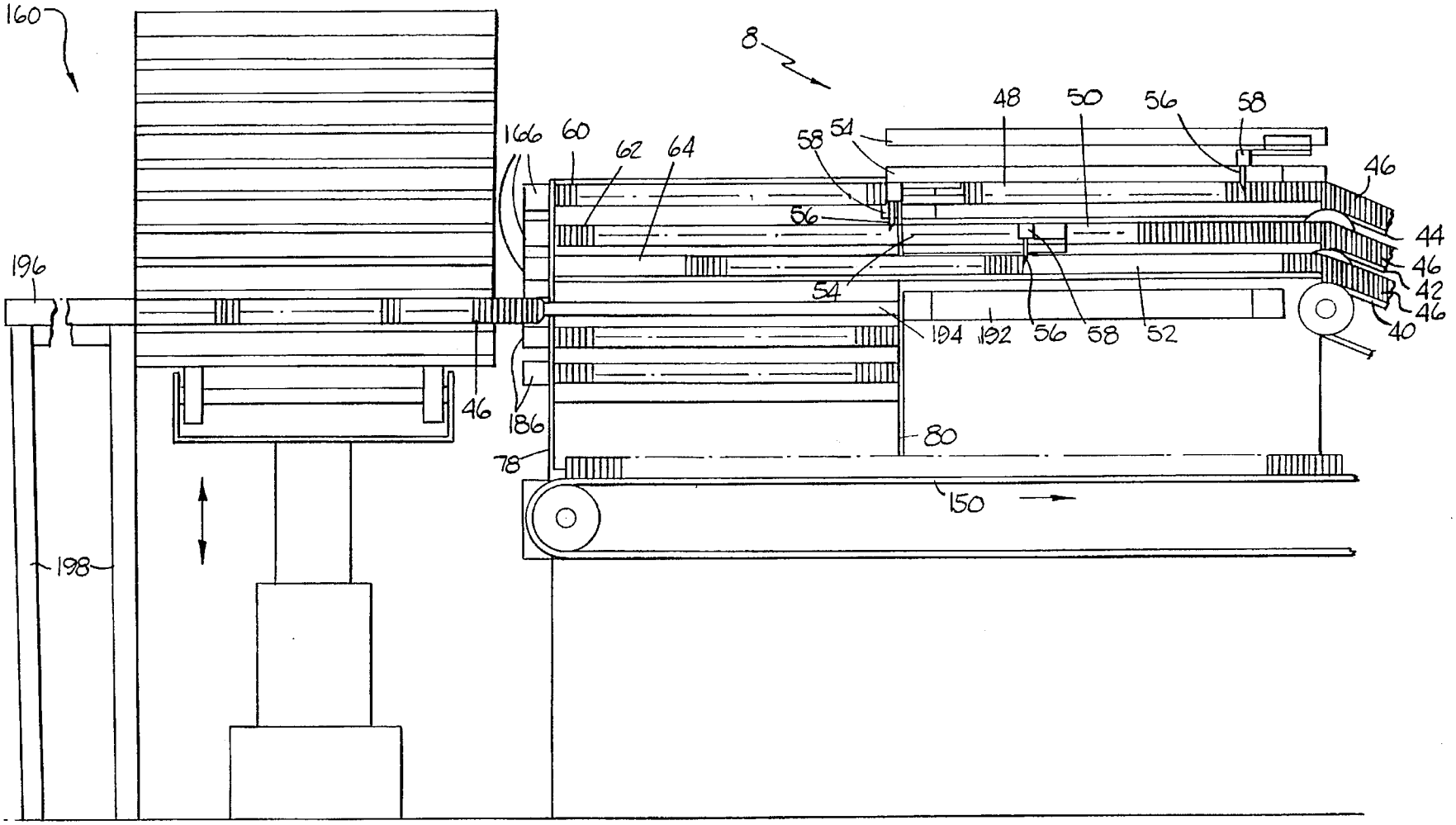
FIG. 2 is a front elevational schematic view of a portion of the apparatus of this invention.
Figure 4:
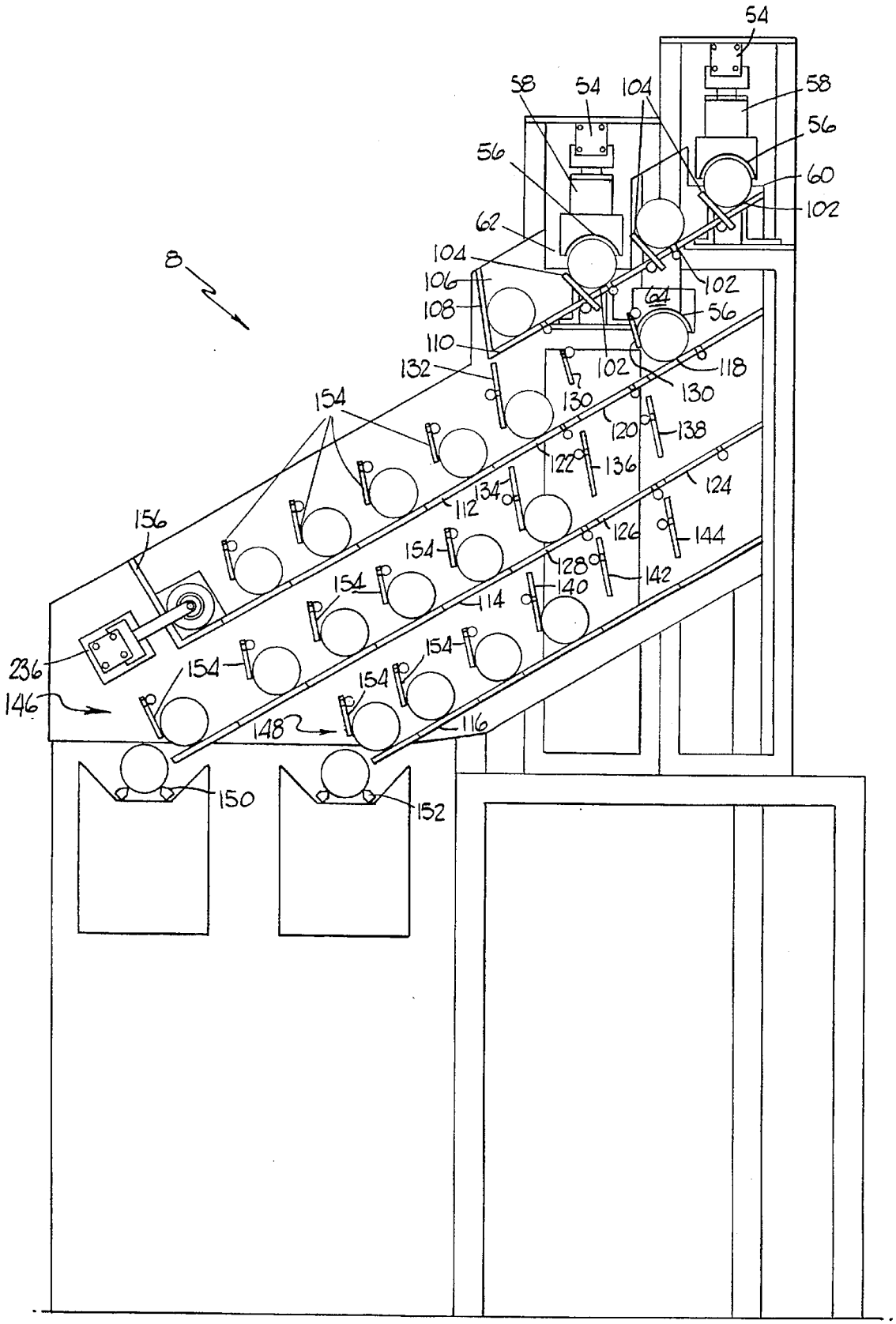
FIG. 4 is an end elevational schematic view of a portion of FIG. 1.
Figure 5:
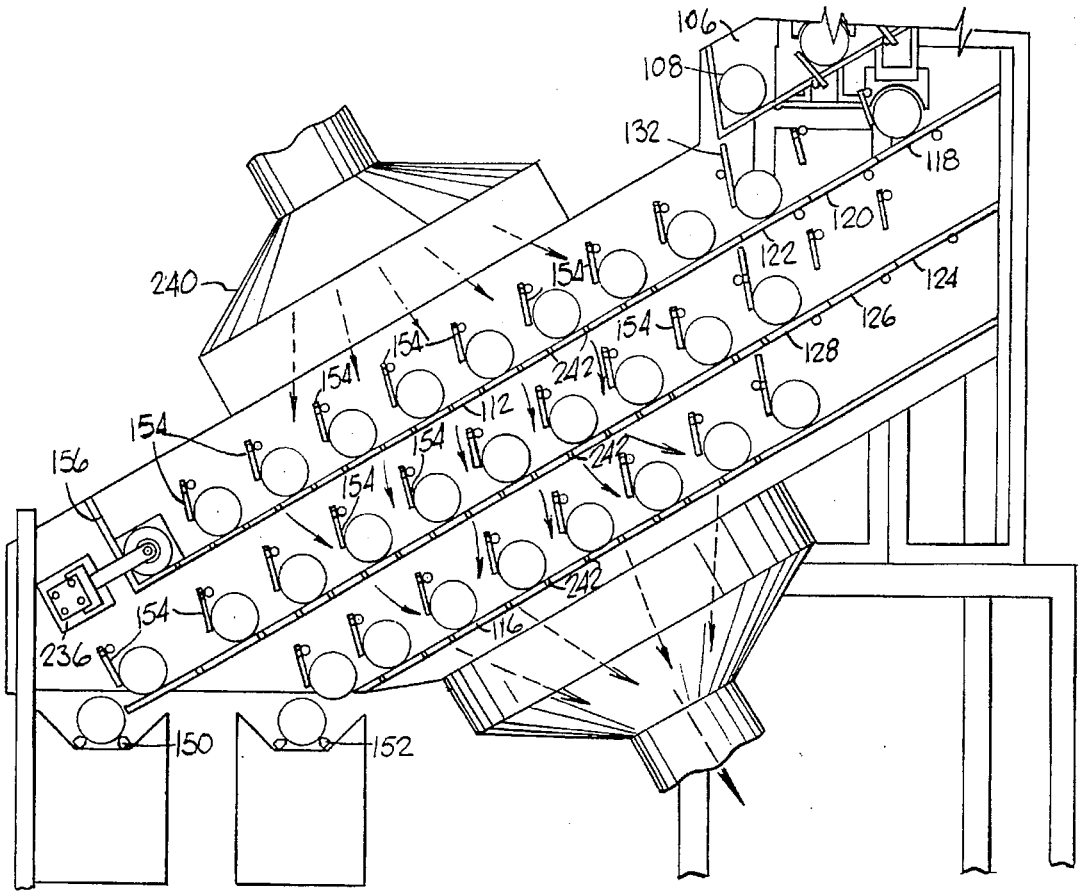
FIG. 5 is an end elevational schematic view of another preferred embodiment of the invention.

In FIG. 2, there is illustrated an LADSS 8 of this invention. Three conveyors 40, 42 and 44 each carry a continuous supply of lids 46 which are fed into three loading stations 48, 50 and 52. While three loading stations are illustrated in FIGS. 2, 4 and 5, it is understood that the number of conveyors and loading stations can be one or more and will be determined by the number of lids that can be processed by other portions of the overall system. A conventional rodless cylinder 54, FIG. 3, is associated with each of the loading stations 48, 50 and 52 and has a knife 56 that is mounted in a cylinder 58 so that the knife 56 may be moved between locations where it is above the lids 46 or between adjacent lids 46. Suitable sensing means (not shown) are provided to move the knife 56 from above the lids 46 to between adjacent lids 46 after a predetermined number of lids 46 has been moved into each of the loading stations 48, 50 and 52 or after a predetermined linear extent of the lids 46 has been moved into each of the loading stations 48, 50 and 52. After a knife 56 has been positioned between two of the lids 46, the rodless cylinder 54 is actuated and the predetermined lids 46 are pushed into one of the three infeed stations 60, 62 and 64.

The operation of the LADSS 8 is explained in relation to FIGS. 2 and 3. Each of the loading stations 48, 50 and 52 has two spaced apart rails 70 for supporting the lids 46. The cylinder 58 is mounted on a support member 72 which projects from and is secured to the exterior moving portion 74 of the rodless cylinder 54 which is mounted on a stationary frame 76. The infeed stations 60, 62 and 64 are located between two walls 78 and 80, FIG. 2, and the wall 80 has an opening 82 for each of the infeed stations 60, 62 and 64 so that the lids 46 may be pushed by the knife 56 over the rails 70 and through the opening 82 into one of the infeed stations 60, 62 and 64. After the lids have been moved into one of the infeed stations 60, 62 and 64 and before the knife 56 is retracted, an abutment member 84 is moved from a location below the opening 82 into and through the opening 82, FIG. 3, into contact with the end lid of the lids in the one of the infeed stations 60, 62 and 64. The abutment member 84 is preferably made from a resilient material, such as a plastic material, such as polyurethane, but could be formed from metal or any other materials having similar characteristics. The abutment member 84 moves the lids 46 so that the end lid is spaced inwardly from the wall 80. The knife 56 is then retracted and the exterior moving portion 74 is moved back so that the knife 56 is located to move the next segment of lids and the abutment member is returned.

The moving means for moving the abutment member 84 comprises a lever arm 86 pivotally mounted by pivot means 88 secured on the wall 80. The lever arm 86 is pivotally connected to a piston rod 90 by pivot means 92. The piston rod 90 is moved into and out of a cylinder 94 by conventional means (not shown). The cylinder 94 such as a pneumatic cylinder, is pivotally mounted on pivot means 96 secured on the wall 80.

As illustrated in FIG. 4, each of the infeed stations 60 and 62 has a bottom surface comprising a fixed portion 102 and a pivoted gate 104 which moves between a location to prevent movement of the lids 46 and a location to cooperate with the fixed portion 102 to provide a generally planar surface that is inclined to the horizontal. When the pivoted gates 104 are in the later locations the lids 46, because of their circular outer rims, can roll over the portions 102 and the pivoted gates 104 in response to the gravitational force. In between the infeed stations 60 and 62, there is an intermediate station that has a bottom surface the same as the infeed stations 60 and 62. Adjacent to the infeed station 62 there is a temporary holding station 106 having a fixed end wall 108 adapted to be contacted by the lids 46 and a pivotal gate 110 for purposes described below. The pivotal gate 110 has a surface aligned with the bottom surfaces of the infeed stations 60 and 62 and the intermediate station. Three generally planar surfaces 112, 114 and 116 are located below the infeed stations 60 and 62, the intermediate station and the holding station 106 and are in a spaced apart relationship in planes generally parallel to the bottom surfaces of the infeed stations 60 and 62, the intermediate station and the holding station 106. The inclination of the bottom surfaces and the generally planar surfaces 112, 114 and 116 is between about 20 and 70 degrees and preferably about 30 degrees. The generally planar surfaces 112 and 114 have a plurality of pivotal gates 118, 120, 122, 124, 126 and 128 for purposes described below. The infeed station 64 is located so that the lids 46 fed into the infeed station 64 are supported on the pivotal gate 118 and are prevented from moving over the pivotal gate 118 by another pivotal gate 130. A plurality of pivotal gates 132, 134, 136, 138, 140, 142 and 144 are pivoted around a centrally located pivot and function to guide the movement of lids 46 from the holding station 106 to the generally planar surface 112 and to other of the generally planar surfaces 114 and 116 and to control the movement of the lids 46 over portions of the generally planar surfaces 112, 114 and 116 as explained below. At the end portions 146 and 148 of the generally planar surfaces 114 and 116 there are located conveyors 150 and 152 for conveying lids 46 to other operations. If only one conveyor is necessary, then generally planar surface 116 would be omitted. If more than two conveyors are needed then additional planar surfaces would be provided. A plurality of additional gates 154 control the movement of the lids 46 over the generally planar surfaces 112, 114 and 116. The pivotal gates 122 and 132 function to provide a holding station for lids 46 that are to be moved to a mass cell storage apparatus described below. The end wall 156 and the generally planar surface 112 function as a holding station for lids 46 that are to be moved to a bagging operation as described below.

Figure 6:
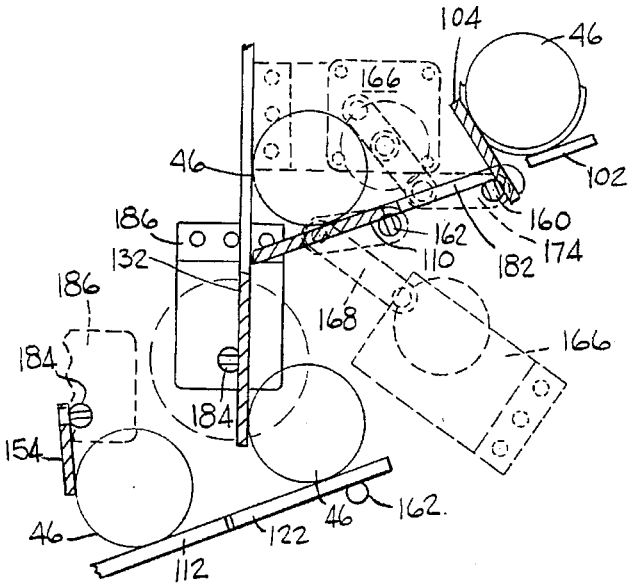
FIG. 6 is an end elevational view of different types of gate means of the invention.
Figure 7:
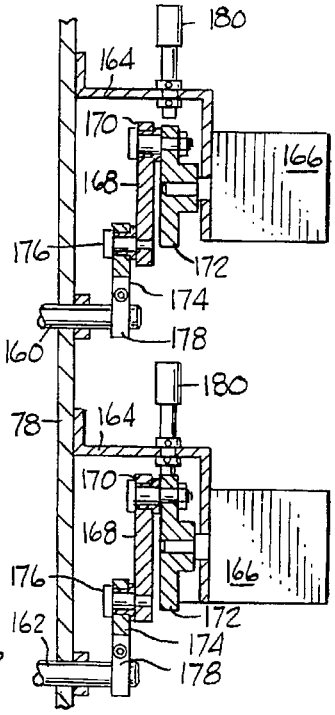
FIG. 7 is a cross-sectional view of a portion of the gate means in FIG. 6.

The apparatus for pivoting the various gates is illustrated in FIGS. 6 and 7. Gates 104 and 110 are connected to rotatable pivot rods 160 and 162. A support member 164 is secured to the wall 78 by suitable means, such as by welding or threaded bolts, and supports a motor 166, such as an electric motor. Similar units in FIGS. 6 and 7 will be given the same reference numerals. An arm 168 is pivotally mounted at an eccentric location 170 on a member 172 rotated by the motor 166. Another arm 174 is pivotally mounted to the arm 168 by pivot means 176 and is clamped to the rod 160 or 162 by clamping means 178 for rotation therewith. A sensor 180 controls the operation of the motor 166 which is programmed to make one revolution of 360 degrees in response to a signal from the sensor 180. During the rotation of the member 172, the gate 104 will pivot to the left, as illustrated in FIG. 6, to fill the empty space 182 to permit the lids 46 to roll thereover and then be returned to the position illustrated in FIG. 6 to prevent the movement of the next plurality of lids 46. The gate 110 is pivoted downwardly, as illustrated in FIG. 6, so that the lids 46 will move downwardly onto the gate 122. As the lids 46 move downwardly, they are in contact with the gate 132. After the lids 46 have been deposited on the gate 122, the gate 110 is returned to the position illustrated in FIG. 6. Gates 118, 120, 122, 124, 126 and 128 are rotated by the means similar to that rotating the rods 160 and 162. The rotatable pivot rods 184 are directly coupled to the rotatable shaft of a motor 186 that is programmed to make one revolution of 360 degrees in response to a signal from a sensor (not shown). If the lids 46 do not move when the gates 132, 134, 140 and 154 are rotated, the gates 132, 134, 140 and 154 will contact them as they move to complete the 360 degrees of rotation and move them over the gate 122 or the generally planar surfaces 112, 114 and 116. Gates 134, 136, 138, 140, 142 and 144 are rotated by means similar to the means rotating the rods 184. Instead of the motors 166, there could be one motor for each of the infeed stations 60, 62 and 64 and all the other gates could be operated from each motor by clutch brakes on each rod.

Figure 10:
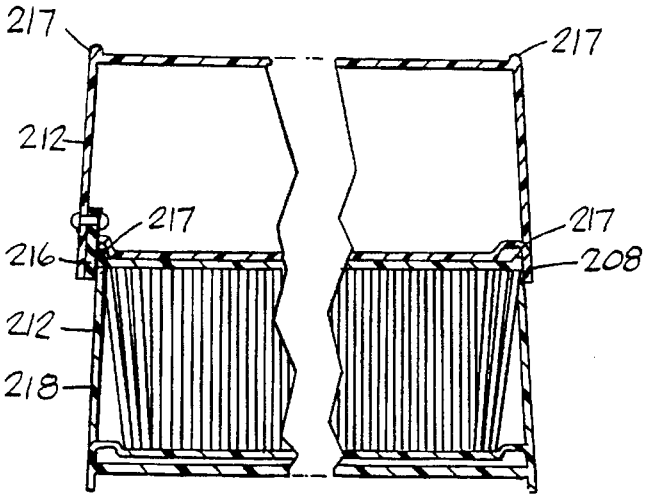
FIG. 10 is a front elevational view with parts in section of FIG. 9.
Figure 11:
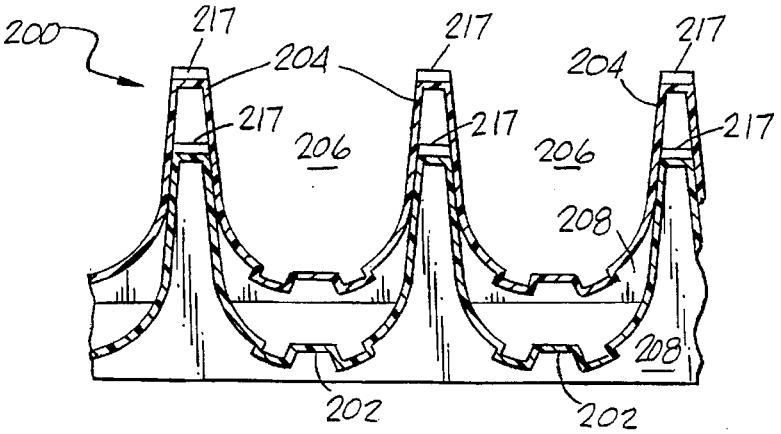
FIG. 11 is an elevational view with parts in section showing the nesting of a plurality of empty trays in storage.
Figure 12:
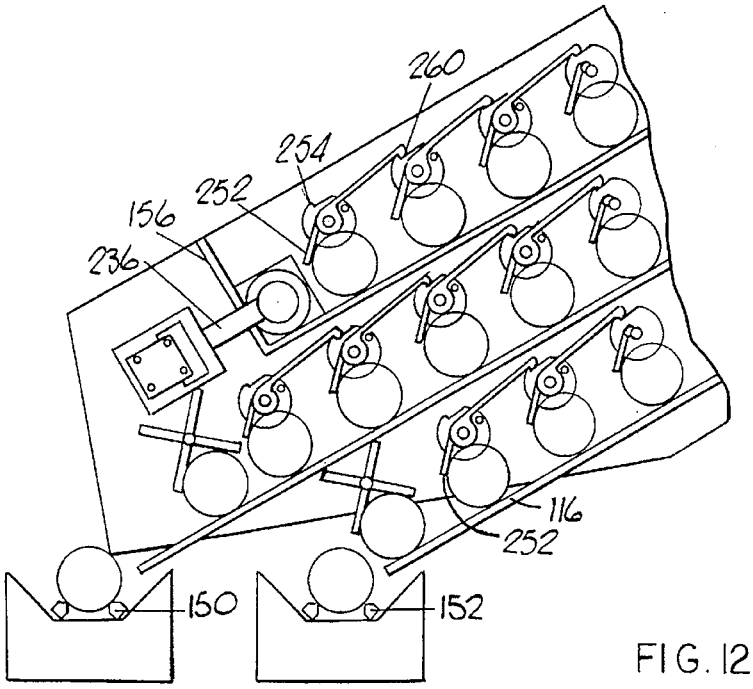
FIG. 12 is an end elevational view of another preferred embodiment of the invention.

The mass cell storage apparatus 190 is illustrated in FIGS. 2 and 8–11. A pneumatic cylinder 192 or other actuating means is mounted on the wall 80 and has a piston rod 194 that contacts the end lid of the plurality of lids 46 in contact with the gates 122 and 132 and move the lids 46 through the opening 82 in the wall 80 into a compartment in a tray, described below. Another pneumatic cylinder 196 or other actuating means is mounted on support means 198 and functions to push lids 46 from the compartment back onto the gate 122 and in contact with the gate 132. The mass cell storage apparatus 190 includes a plurality of trays 200, FIGS. 8–11. Each of the trays 200 has a base section 202 and sidewalls 204 projecting upwardly therefrom to form a plurality of compartments 206. Each tray 200 has an end wall 208 which serves as an abutment for an end lid of a plurality of lids 46 in an underneath compartment 206. Each of the trays 200 has another end wall 212 having a plurality of spaced apart cut out portions 214. A plurality of flexible arms 216 are secured to the end wall 212 and extend downwardly into the cut out portions 214 and function as an abutment for the other end lid 218 of the plurality of lids 46 in an underneath compartment 206. Each of the flexible arms 216 is formed from a resilient long lasting material such as rubber, polyurethane, or other materials having similar characteristics. As illustrated in FIG. 10 the end walls 208 and 212 are inclined to the vertical so that the trays 200 can be stacked on each other and keep the base sections 202 spaced from the lids 46. A projection 217 at the end of each sidewall 204 cooperates with end wall 208 or the resilient strip 216 to prevent relative longitudinal movement between trays 200. In FIG. 11, the trays 200 are shown in a nested relationship for storage.

Figure 8:
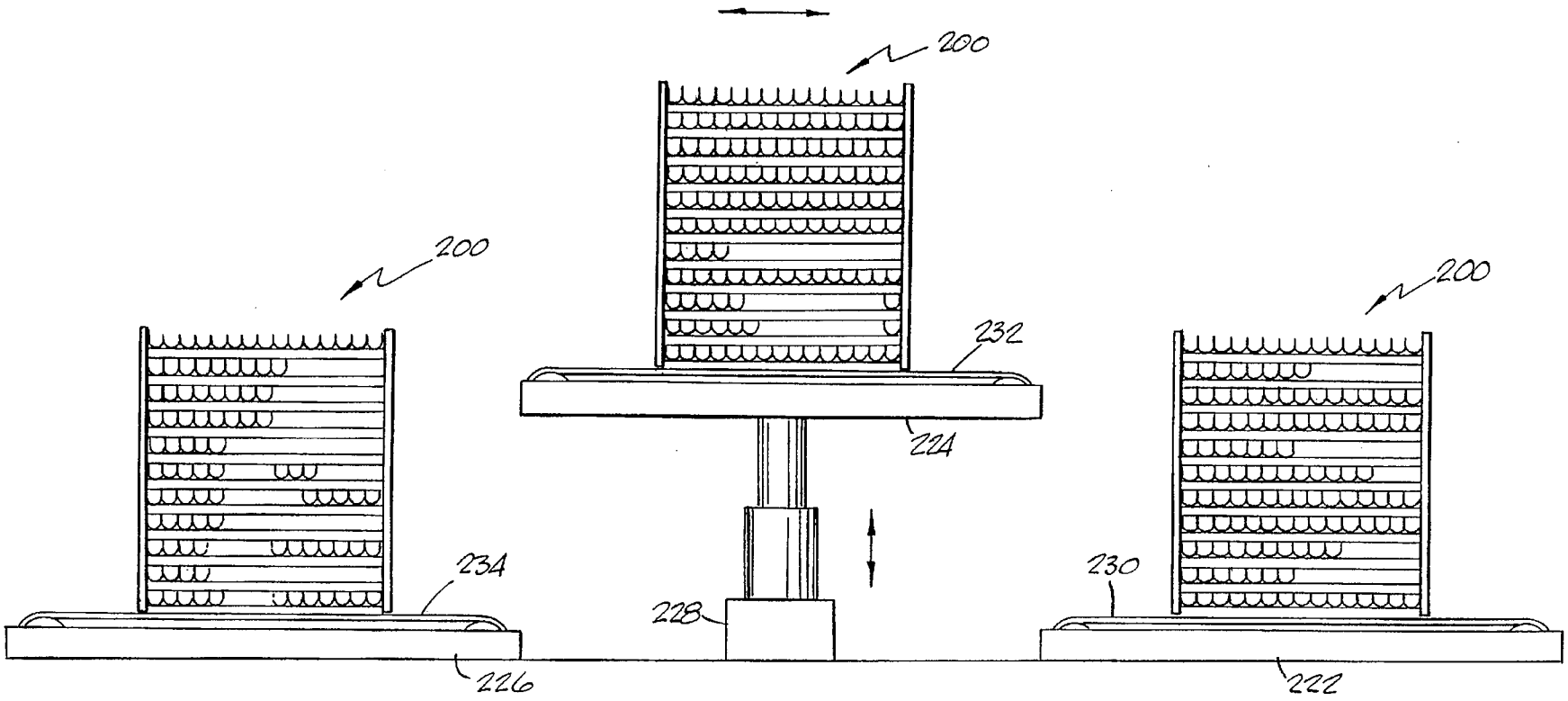
FIG. 8 is a schematic elevational view of a storage system of this invention.
Figure 9:
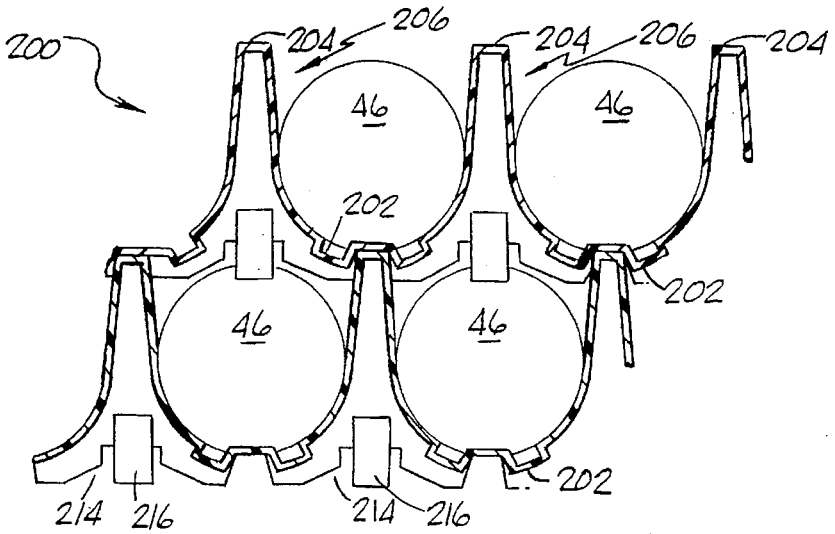
FIG. 9 is an end elevational view with parts in section of portions of two trays for the storage system.

The manner of using the trays 200 is illustrated in FIGS. 2 and 8. A plurality of conveyors 222, 224 and 226 are located to be in alignment. There may be additional conveyors (not shown) to cooperate with the conveyors 222 and 226. The trays 200 on conveyor 222 are empty, the trays 200 on conveyor 224 are in the process of being filled with lids 46 and the trays 200 on conveyor 226 have been filled with lids 46. The conveyor 224 is mounted on an indexing lift 228. In operation, the conveyor 224 is lowered and has no trays 200 thereon. The conveyor belts 230 and 232 are positioned so that the trays 200 on the conveyor belt 230 are moved to the conveyor belt 232 and moved to a predetermined location. The conveyor belt 232 is connected to indexing means (not shown) so that it can be indexed to move in horizontal directions, FIG. 8, while the indexing means 228 indexes in vertical directions. This arrangement permits a compartment 206 to be positioned relative to gates 122 and 132 so that lids 46 may be moved from gates 122 and 132 into a compartment 206 or from a compartment 206 onto gates 122 and 132. After the trays 200 on conveyor 224 have been filled with lids 46, it is lowered and the conveyor belts 232 and 234 are activated to move the trays 200 on the conveyor belt 232 filled with lids onto conveyor belt 234.

The operation of the apparatus is illustrated in FIGS. 1, 2 and 4 and will be described in relation to uncoated lids 46 being received from the lid liners 14 and 16. As illustrated in FIG. 2, lids 46 are conveyed by conveyors 40, 42 and 44 into the loading stations 48, 50 and 52. A sensor (not shown) senses the movement of the lids 46 into each loading station 48, 50 and 52 and when a predetermined number of lids 46 have been moved into one of the loading stations 48, 50 and 52, the cylinder 58 is activated to move the knife 56 downwardly and the rodless cylinder 54 is activated to push the lids 46 on one of the loading stations 48, 50 and 52 into one of the infeed stations 60, 62 and 64. After the lids 46 have been moved into infeed station 60, the gate 104 is activated so that the lids 46 will roll over the fixed portion 102 and the gate 104 into the intermediate station. After the lids 46 have been moved into the infeed station 62, the gate 104 is actuated so that the lids 46 move over the fixed portion 102 and the gate 104 onto the gate 110 and against the wall 108 of the temporary holding station 106. The gate 110 is then actuated so that the lids 46 move over the gate 110 and against the gate 132 until they contact the gate 122 and the gate 110 is then returned. The gates 104 are actuated to allow the lids 46 in the intermediate station to roll into the temporary holding station 106. Depending on the needs of the conversion press 14, the lids 46 on the gate 122 can be moved downwardly by the gates 122 and 128 for movement over the generally planar surfaces 114 and 116 and onto the processing conveyors 150 and 152 for movement to the conversion press 24. If no lids are required by the conversion press 24, the pneumatic cylinder 192 or other actuating means is actuated and the piston rod 194 moves the lids 46 into one of the compartments 206. If the lids 46 are not moved into a compartment 206, the gates 154 may be actuated to allow the lids 46 to roll over the generally planar surface 112 until they are in contact with the wall 156. A rodless cylinder 236 will then be activated to move the lids 46 into a bagger 22. After the lids 46 have been moved into infeed station 64, either the gates 118 and 124 can be actuated to move the lids 46 over the generally planar surfaces 114 or 116 or the gates 130 can be actuated to move the lids 46 onto the gate 122 and then either to mass cell storage or bagger as described above. It is understood that the components in FIG. 3 are for illustration purposes only and the number of each of the components may be varied as desired.

In FIG. 5 there is illustrated another preferred embodiment of the invention. In some instances, the lid liners 14 and 16 will apply a heat curable coating to the lids 46. In FIG. 5, a housing 240 is mounted so that the generally planar surfaces 112, 114 and 116 pass through the housing 240. Heating means, such as a blower blowing heated air, radiant heaters or other heating means (not shown) are located in the housing 240. The generally planar surfaces 112, 114 and 116 are made fluid permeable by providing them with a plurality of spaced apart slots 242 extending in transverse directions. In this embodiment, the pneumatic cylinder 192 would be located to move the lids 46 into the mass cell storage from the gate 154 immediately preceding the end wall 156. The generally planar surfaces 112, 114 and 116 are made longer to allow time for the heat curable coating to cure.

Figure 13:
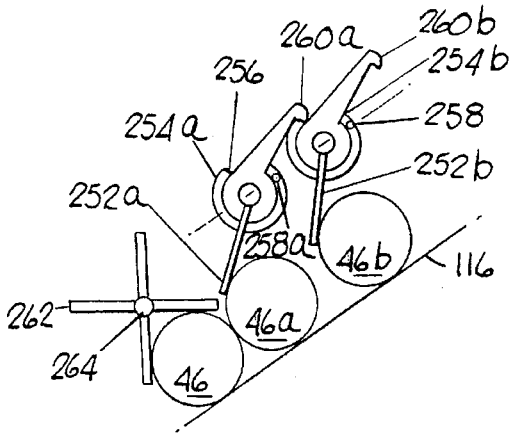
FIGS. 13–15 are end elevational views illustrating the operation of the preferred embodiment in FIG. 12.
Figure 15:
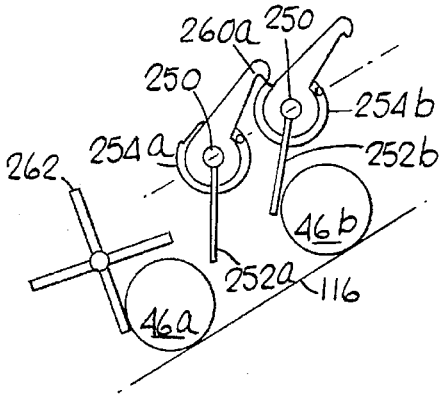
Figure 14:
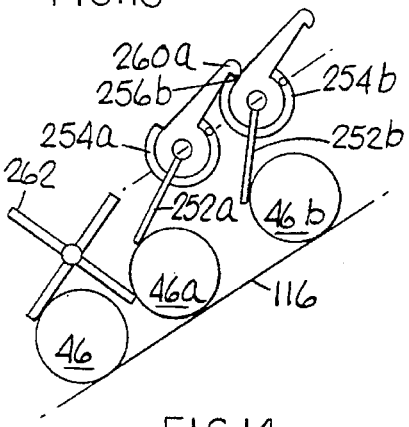
Figure 16:
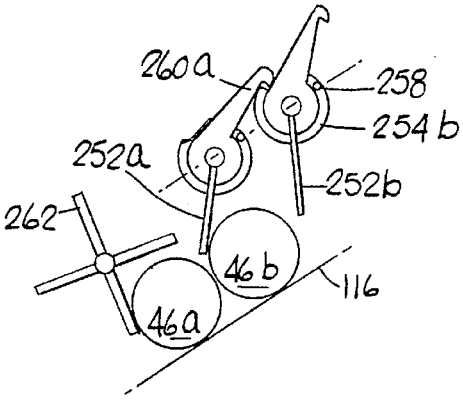

In FIGS. 12–16, there is illustrated a mechanical system for permitting or preventing the movement of the lids 46 over the generally planar surfaces 112, 114 and 116. A plurality of shafts 250 are rotatably mounted in the walls 78 and 80. A gate 252 is mounted on each shaft 250 so that movement of the gate 252 rotates the shaft 250. A latch cam 254 having an abutment surface 256 is mounted on each shaft 250 for rotation therewith. Each latch cam 254 has a cam pin 258 mounted at a fixed location thereon. A freely pivoting latch 260 is mounted on each shaft 250 and is located so as to cooperate with the abutment surface 256 as described below. A four way gate 262 is mounted on a shaft 264 and is rotated by suitable means (not shown). The operation is illustrated in FIGS. 13–16. In FIG. 13, the system is at rest. In FIG. 14, the four way gate 262 has been partially moved and the lids 46 have been moved so that lids **46*a* will move under the gravitational force over the generally planar surface 116 and rotate the latch cam 254*a*. The latch 260*a* in contact with the abutment surface 256*b* will prevent movement of the latch cam 254*b* so that gate 252*b* will prevent movement of the lids 46*b*. In FIG. 15, lids 46*a* have moved into contact with the four way gate 262 so that gate 252*a* will move downwardly under the gravitational force and cam pin 258*a* will move the latch 260*a* upwardly so that latch cam 254*b* is now free to rotate so that lids 46*b* are free to move the gate 252*b* and roll over the generally planar surface 116 until they contact gate 252*a* and lids 46*a*. Latch 260*a* moves into contact with the abutment surface 256*b* to put the system back to that illustrated in FIG. 14**.

While illustrative and presently preferred embodiments of the invention have been described in detail herein, it is to be understood that the inventive concepts may be otherwise variously embodied and employed and that the appended claims are intended to be construed to include such variations except insofar as limited by the prior art.

What is claimed is:

1. Apparatus for moving a plurality articles to a desired one of a plurality of locations comprising:

at least one infeed station;

moving apparatus for moving a plurality of articles in succession into said at least one infeed station;

said plurality of articles having opposite end articles;

said at least one infeed station having a bottom surface which is generally planar and inclined relative to the horizontal;

each of said articles having a circular outer surface adapted to roll over said bottom surface in response to a gravitational force placed thereon;

first abutment devices associated with said at least one infeed station for contacting said opposite end articles of each plurality of articles in said at least one infeed station so that said generally circular outer surfaces of said plurality of articles are in contact with said bottom surface;

at least two generally planar surfaces being vertically spaced apart in a generally parallel relationship and inclined to the horizontal and located so that said plurality of articles can be transferred from said at least one infeed station onto at least one of said at least two generally planar surfaces;

first transfer apparatus for transferring said plurality of articles from said at least one infeed station onto said at least one of said at least two generally planar surfaces;

second and third abutment means associated with said at least two generally planar surfaces located to be contacted by said opposite end articles so that a plurality of articles will roll over each of said at least two generally planar surfaces;

second transfer apparatus for permitting movement of said plurality of articles over said at least one of said at least two generally planar surfaces or transferring said plurality of articles onto the other one of said at least two generally planar surfaces for movement thereover;

control apparatus for controlling the movement of said first and second transfer apparatus to move said plurality of articles out of said at least one infeed station and over at least one of said at least two generally planar surfaces or;

each of said at least two generally planar surfaces having an end portion;

first moving apparatus in operating relationship with said at least one of said at least two generally planar surfaces for moving said plurality of articles from said at least one of said at least two generally planar surfaces to a first processing apparatus; and second moving apparatus in operating relationship with said other one of said at least two generally planar surfaces for moving said plurality of articles from said other one of said at least two generally planar surfaces to a second processing apparatus.

2. Apparatus as in claim 1 wherein:

article storage apparatus located adjacent to at least one of said at least two, generally planar surfaces;

third transfer apparatus for transferring said plurality of articles from said at least one of said at least two generally planar surfaces into said article storage apparatus; and said control apparatus also controlling the movement of said third transfer apparatus.

3. Apparatus as in claim 1 wherein:

said at least one infeed station comprises a plurality of spaced apart infeed stations.

4. Apparatus as in claim 3 wherein said control apparatus comprises:

first gate apparatus for preventing movement of said plurality of articles out of at least one of said plurality of spaced apart infeed stations;

first pivot apparatus for pivoting said first gate apparatus between locations for preventing or permitting movement of said plurality of lids out of said at least one of said plurality of spaced apart infeed stations;

at least one holding station having a bottom surface aligned with said bottom surface of at least one of said plurality of spaced apart infeed stations so that said plurality of articles can move out of said at least one of said plurality of spaced apart infeed stations and into said at least one holding station and at least one third abutment device for retaining said plurality of articles in said holding station and in contact with said bottom surface thereof;

second gate apparatus comprising at least a portion of said bottom surface of said at least one holding station;

at least one of said at least two generally planar surfaces having at least a portion thereof located beneath said at least one holding station;

second pivot apparatus for pivoting said second gate apparatus between locations for supporting said plurality of articles on said second gate apparatus or permitting movement of said plurality of articles out of said at least one holding station and onto said at least a portion of said at least one of said at least two generally planar surfaces;

the other of said at least two generally planar surface having at least a portion thereof located beneath said at least a portion of said at least one of said two generally planar surfaces;

third gate apparatus comprising said at least a portion of said at least one of said two generally planar surfaces; and third pivot apparatus for pivoting said third gate apparatus between locations for supporting said plurality of articles on said third gate apparatus or permitting movement of said plurality of articles from said third gate apparatus and onto said at least a portion of said other of said at least two generally planar surfaces.

5. Apparatus as in claim 4 and further comprising:

fourth gate apparatus for preventing movement of said plurality of articles on said at least a portion of said at least one or said other of said at least two generally planar surfaces; and fourth pivot apparatus for pivoting said fourth gate apparatus to permit movement of said plurality of articles out of said at least a portion of said at least one or said other of said at least two generally planar surfaces onto the remaining portion of said at least one or said other of said at least two generally planar surfaces.

6. Apparatus as in claim 5 wherein:

said fourth pivot apparatus pivoting said fourth gate apparatus through 360 degrees so as to apply a force on the plurality of articles to start movement thereof in the event that movement thereof has not been commenced.

7. Apparatus as in claim 5 and further comprising:

at least one additional gate apparatus on each of said at least two generally planar surfaces for preventing movement of a plurality of articles;

said at least one additional gate apparatus being located before said first or second moving apparatus;

additional pivot apparatus for each of said additional gate apparatus for pivoting said additional gate apparatus between locations for preventing or permitting movement of said plurality of articles on said at least two generally planar surfaces;

said first moving means moving said plurality of articles in one direction to said first processing apparatus and said second moving means moving said plurality of articles in an opposite direction to said second processing apparatus.

8. Apparatus as in claim 7 wherein:

said additional pivot apparatus pivoting each of said additional gate apparatus through 360 degrees so as to apply a force on a plurality of articles to start movement thereof in the event that movement thereof has not been commenced.

9. Apparatus as in claim 5 wherein:

said plurality of articles moving from said at least one holding station to said at least a portion of said at least one of said at least two generally planar surfaces being in contact with portions of said first gate apparatus, said second gate apparatus and said third gate apparatus during at least fifty percent of the movement thereof.

10. Apparatus as in claim 1 wherein:

said at least one infeed stations comprises at least three infeed stations each having a bottom surface.

11. Apparatus as in claim 10 wherein:

said bottom surfaces of at least two of said at least three infeed stations are in alignment.

12. Apparatus as in claim 10 wherein:

said at least two generally planar surfaces comprising at least three generally planar surfaces being vertically spaced apart and in a generally parallel relationship and inclined relative to the horizontal;

said transfer apparatus comprising a plurality of gate apparatus controlling the movement of said plurality of articles over and out of said at least three infeed stations and onto at least one of said at least three generally planar surfaces; and third moving apparatus in operating relationship with another of said at least three generally planar surfaces for moving said plurality of articles from said another of said at least three generally planar surfaces to a third processing apparatus.

13. Apparatus as in claim 12 wherein:

said at least three generally planar surfaces lying in planes vertically spaced from the planes of said bottom surfaces of said at least two of said at least three infeed stations.

14. Apparatus as in claim 13 wherein said plurality of gate apparatus comprise:

a plurality of first gate apparatus movable between locations for preventing or permitting movement of a plurality of articles over an associated one of said at least three generally planar surfaces; and a plurality of second gate apparatus movable between locations for preventing or permitting movement of a plurality of articles from an association with an upper one of said at least three generally planar surfaces to an association with a lower one of said at least three generally planar surfaces.

15. Apparatus as in claim 14 and further comprising:

article storage apparatus located adjacent to at least one of said at least three generally planar surfaces; and pushing means for pushing a plurality of articles from said at least one of said at least three generally planar surfaces into said articles storage apparatus.

16. Apparatus as in claim 14 and further comprising:

pivot apparatus for pivotally mounting at least a plurality of said plurality of first gate apparatus for pivotal movement of 360 degrees so as to apply a force on said plurality of articles to start movement thereof in the event that movement thereof has not been started.

17. Apparatus as in claim 14 and further comprising:

a housing;

each of said plurality of articles having a heat curable coating on at least portions thereof;

said at least three generally planar surfaces passing through said housing;

said plurality of articles as they are moved into said infeed stations having a distance between said opposite end articles that is smaller than the distance between said second abutment devices; and heating apparatus in said housing for applying heat to said plurality of articles as they pass over an associated inclined surface in said housing to cure said heat curable coatings.

18. Apparatus as in claim 17 and further comprising:

said at least three generally planar surfaces being fluid permeable; and said heating apparatus comprising at least one air blowing device for moving heated air over and through said plurality of articles and said fluid permeable at least three generally planar surfaces.

19. Apparatus as in claim 1 and further comprising:

each of said plurality of articles having a heat curable coating on at least a portion thereof;

a housing;

said at least two generally planar surfaces passing through said housing; and heating apparatus in said housing for applying heat to said plurality of articles as they pass over an associated inclined surface in said housing to cure said heat curable coating.

20. Apparatus as in claim 19 and further comprising:

each of said at least two generally planar surfaces being fluid permeable; and said heating apparatus comprising at least one air blowing device for moving heated air over and through said plurality of articles and said fluid permeable at least two generally planar surfaces.

21. Apparatus for processing lids for containers having a heat curable coating on at least portions thereof comprising:

at least one generally planar surface inclined to the horizontal;

opposite sidewalls extending upwardly from said at least one generally planar surface;

a housing;

said at least one generally planar surface passing through said housing;

a plurality of lids having opposite end lids in contact with said opposite sidewalls;

each of said plurality of lids having a circular outer rim for rolling movement over said at least one generally planar surface; and heating apparatus in said housing for applying heat to said plurality of lids as they pass over said at least one generally planar surface in said housing to cure said heat curable coating.

22. Apparatus as in claim 21 and further comprising:

said at least one generally planar surface being fluid permeable; and said heating apparatus comprising at least one air blowing device for moving heated air over and through said plurality of lids and said fluid permeable said one generally planar surface.

23. Apparatus as in claim 1 and further comprising:

a storage system comprising a plurality of trays in a stacked superposed relationship;

each of said trays comprising a plurality of spaced apart base members and sidewalls projecting upwardly from said base members to form a plurality of spaced apart compartments;

each of said compartments having opposite end portions;

each of said compartments dimensioned to hold a plurality of articles;

each of said articles having a circular outer rim with portions thereof in contact with portions of said base members and said sidewalls;

abutment devices at each of said opposite end portions for contacting an end article of said plurality of articles in an underneath compartment to retain said plurality of articles in said underneath compartment; and at least one of said abutment devices being flexible to be moved to a location permitting said plurality of articles to be pushed into each of said underneath compartments and to return to a location in contact with one of said end articles of said plurality of articles.

24. Apparatus as in claim 23 wherein:

the other of said abutment devices comprises a first end wall integral with said base members and said sidewalls and projecting downwardly therefrom;

a second end wall integral with said base members and said sidewalls and projecting downwardly therefrom;

said second end wall having a plurality of cut out portions located beneath each of said sidewalls; and said at least one of said abutment devices comprising a flexible strip of material secured to each of said sidewalls and extending downwardly into each of said cut out portions.

25. Apparatus as in claim 24 wherein:

each of said first and second end walls being inclined relative to a vertical direction to permit nesting of said trays.

26. Apparatus as in claim 23 and further comprising:

at least one of said gate apparatus and a portion of said at least one of said at least two of planar surfaces forming holding apparatus for holding a plurality of articles so as to have a longitudinal axis;

each of said compartments having a longitudinal axis;

movable support apparatus for supporting said plurality of trays for movement in vertical and horizontal directions;

indexing apparatus for moving said support means to successively move said longitudinal axis of each of said compartments into alignment with said longitudinal axis of said articles in said holding apparatus; and moving apparatus for moving said plurality of articles from said holding apparatus into one of said compartments so that another plurality of articles can move into said holding apparatus to be moved into another compartment.

27. Apparatus for holding a plurality of lids for containers comprising:

a storage system comprising a plurality of trays which can be stacked in a superposed relationship;

each of said trays comprising a plurality of spaced apart base members and sidewalls projecting upwardly from said base members to form a plurality of spaced apart compartments;

each of said compartments having opposite end portions;

each of said compartments dimensioned to hold a plurality of lids;

each of said lids having a circular outer rim with portions thereof in contact with portions of said base members and said sidewalls;

abutment devices at each of said opposite end portions for contacting an end lid of said plurality of lids in an underneath compartment to retain said plurality of lids in said underneath compartment; and at least one of said abutment devices being flexible to be moved to a location permitting said plurality of lids to be pushed into each of said underneath compartments and to return to a location in contact with one of said end lids of said plurality of lids.

28. Apparatus as in claim 27 wherein:

the other of said abutment devices comprises a first end wall integral with said base members and said sidewalls and projecting downwardly therefrom;

a second end wall integral with said base members and said sidewalls and leaving an opening into each of said compartments;

said second end wall having a plurality of cut out portions located beneath each of said sidewalls; and said at least one of said abutment devices comprising a flexible strip of material secured to each of said sidewalls and extending downwardly into each of said cut out portions.

29. Apparatus as in claim 28 wherein:

each of said first and second end walls being inclined relative to a vertical direction to permit nesting of said trays.

30. Apparatus as in claim 28 and further comprising:

holding apparatus located adjacent to at least a portion of said storage system for holding said plurality of lids with portions of said circular outer rims in contact with said holding apparatus;

said holding apparatus having a longitudinal axis;

each of said compartments having a longitudinal axis;

movable support apparatus for supporting said plurality of trays and for movement in vertical and horizontal directions;

indexing apparatus for moving said support means to successively move said longitudinal axis of each of said compartments into alignment with said longitudinal axis of said holding apparatus;

first moving apparatus for moving said plurality of lids from said holding apparatus into one of said compartments; and second moving apparatus for moving another plurality of lids into said holding apparatus.

31. Apparatus as in claim 30 and further comprising:

third moving apparatus for moving a plurality of lids out of one of said compartments and into said holding apparatus.

32. Apparatus as in claim 1 and further comprising:

a plurality of motors for moving said plurality of gate means between an opened or a closed position.

33. Apparatus as in claim 32 and further comprising:

linkage apparatus connected to at least one of said motors and at least one of said plurality of gate apparatus so that for each revolution of 360 degrees of said at least one of said electric motors said at least one of said plurality of gate apparatus moves to said opened location and back to said closed location.

34. Apparatus as in claim 1 and further comprising:

mechanical apparatus for controlling the movement of a plurality of said plurality of gate apparatus between an opened or a closed location.

35. Apparatus as in claim 34 wherein said mechanical apparatus comprises:

a plurality of spaced apart shafts;

each of said shafts rotatably mounted in a fixed support;

a gate mounted on each of said shaft for rotational movement therewith;

a latch cam having an abutment surface thereon on each shaft for rotation therewith;

a freely pivoted latch mounted on said shaft and located to move into contacting relationship with said abutment surface; and a cam pin mounted on said latch cam and located so as to contact said freely pivoted latch and move said freely pivoted latch out of contact with said abutment surface.

36. Apparatus as in claim 3 and further comprising:

said plurality of infeed stations comprising at least three infeed stations;

said at least two generally planar surfaces comprising at least three generally planar surfaces in a vertically spaced apart generally parallel relationship;

article storage apparatus located adjacent to said at least one of said at least three generally planar surfaces;

pushing apparatus for pushing a plurality of articles from said at least one of said at least three generally planar surfaces into said article storage apparatus;

said article storage apparatus comprising a plurality of trays which can be stacked in a superposed relationship;

each of said trays comprising a plurality of spaced apart base members and sidewalls projecting upwardly from said base members to form a plurality of spaced apart compartments;

each of said compartments having opposite end portions;

each of said compartments dimensioned to hold a plurality of articles;

each of said plurality of articles having a circular outer rim with portions thereof in contact with portions of said base members and said sidewalls;

abutment devices at each of said opposite end portions for contacting an end article of said plurality of articles in an underneath compartment to retain said plurality of articles in said underneath compartment; and at least one of said abutment devices being flexible to be moved to a location permitting said plurality of articles to be pushed into each of said underneath compartments and to return to a location in contact with one of said end articles of said plurality of articles.

37. Apparatus as in claim 36 wherein:

the other of said abutment devices comprises a first end wall integral with said base members and said sidewalls and projecting downwardly therefrom;

a second end wall integral with said base members and said sidewalls and leaving an opening into each of said compartments;

said second end wall having a plurality of cut out portions located beneath each of said sidewalls; and said at least one of said abutment devices comprising a flexible strip of material secured to each of said sidewalls and extending downwardly into each of said cut out portions.

38. Apparatus as in claim 37 wherein:

each of said first and second end walls being inclined relative to a vertical direction to permit nesting of said trays.

39. Apparatus for moving a plurality articles to a desired one of a plurality of locations comprising:

at least one infeed station;

moving means for moving a plurality of articles in succession into said at least one infeed station;

said plurality of articles having opposite end articles;

said at least one infeed station having a bottom surface which is generally planar and inclined relative to the horizontal;

each of said articles having a circular outer surface adapted to roll over said bottom surface in response to a gravitational force placed thereon;

first abutment means associated with said at least one infeed station for contacting said opposite end articles of each plurality of articles in said at least one infeed station so that said generally circular outer surfaces of said plurality of articles are in contact with said bottom surface;

at least one holding station having a generally planar bottom surface inclined to the horizontal for supporting said plurality of articles;

at least one generally planar surface inclined to the horizontal and located so that said plurality of articles can be transferred from said at least one holding transfer station onto said at least one generally planar surface;

first transfer apparatus for transferring said plurality of articles from said at least one infeed station onto said at least one holding station;

article storage apparatus located adjacent to said at least one holding station;

second transfer apparatus for transferring said plurality of articles from said at least one holding station onto said at least one generally planar surface or for transferring said plurality of article from said at least one holding station into said article storage apparatus;

moving apparatus in operative relationship with said at least one generally planar surface for receiving said plurality of articles from said at least one generally planar surface and moving said plurality of articles to a processing apparatus; and control apparatus for controlling the movement of said first and second transfer apparatus for moving said plurality of articles from said at least one infeed station into said at least one holding station and from said at least one holding station onto said at least one generally planar surface or from said at least one holding station into said article storage apparatus.

* * * * *